United States Patent [19]

Clark

[11] 4,113,038

[45] Sep. 12, 1978

[54] DRILLING JAR

[76] Inventor: George M. Clark, Box 92002, Houston, Tex. 77006

[21] Appl. No.: 788,625

[22] Filed: Apr. 18, 1977

[51] Int. Cl.[2] ..... E21B 17/00

[52] U.S. Cl. ..... 175/300; 175/321

[58] Field of Search ..... 175/300, 299, 304, 301, 175/321, 293

[56] References Cited

U.S. PATENT DOCUMENTS

| | | | |
|---|---|---|---|
| 2,819,879 | 1/1958 | Beck | 175/300 |
| 3,585,301 | 6/1971 | Newman | 175/300 |
| 4,004,643 | 1/1977 | Newman | 175/300 |

*Primary Examiner*—Ernest R. Purser
*Assistant Examiner*—William F. Pate, III
*Attorney, Agent, or Firm*—Donald Gunn

[57] ABSTRACT

A drilling jar to be installed in a set of drill collars in a drill string is disclosed. In the illustrated embodiment, first and second tubular members telescope relative to one another. At the upper end of the lower tubular member, a set of protruding lugs match shoulders having undercuts which permit relative rotation of the two tubular members through part of a turn, thereby permitting the two members to axially telescope whereby locking or unlocking the telescoping movement is controlled. The lower tubular member has an upwardly facing shoulder which is abutted against the lower end of the upper tubular member. This permits the two to be reciprocated and banged together to create a jar for the drill string. When the string is jarred, the drill string can be jarred loose. the apparatus further includes a packer around a pipe positioned in the upper end of the upper tubular member.

9 Claims, 3 Drawing Figures

FIG. 1A
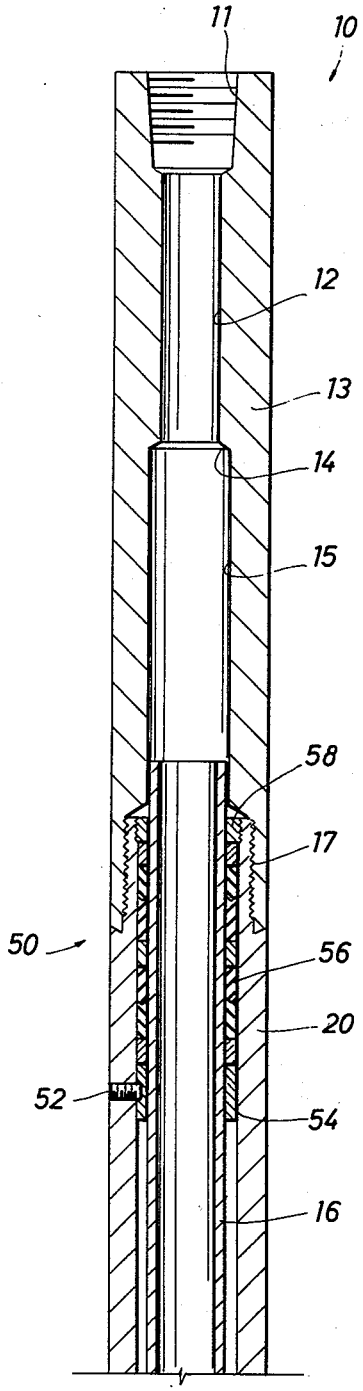
FIG. 1B
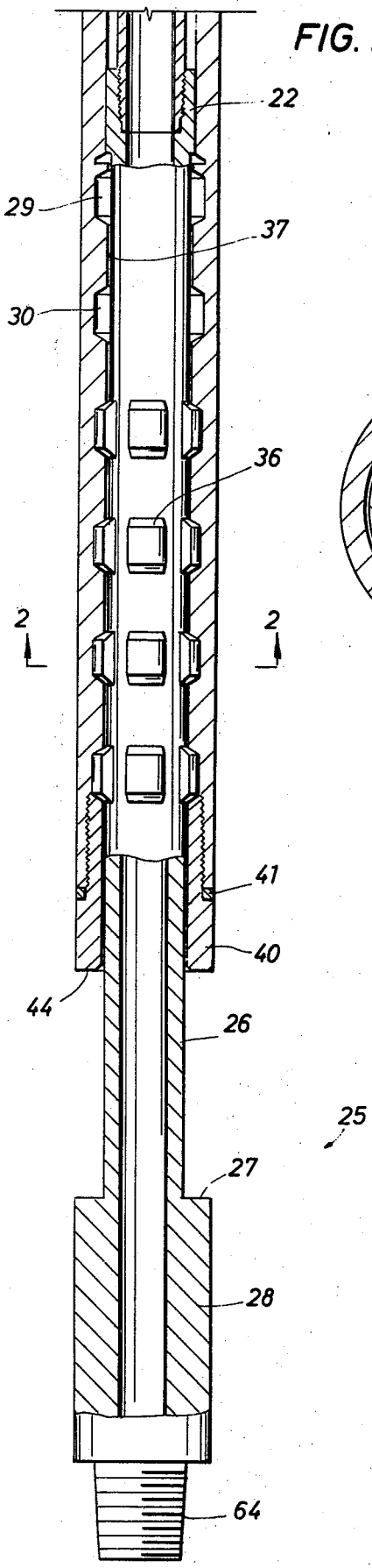
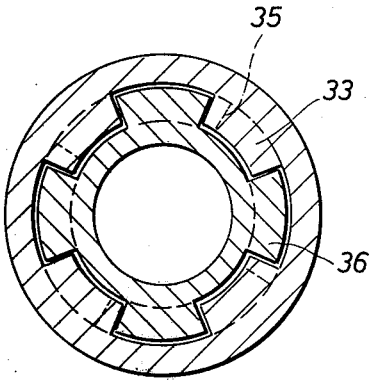
FIG. 2

DRILLING JAR

BACKGROUND OF THE PROBLEM

When an oil well is drilled, the drill bit is positioned at the bottom of the drill string and a set of heavy, thick walled drill collars is located in the drill string immediately above the drill bit. The drill collars add stiffness to the drill string, control the weight on the drill bit, and thereby control lateral drift or deviation of the drill string. The number of drill collars in a drill string will vary depending on the depth of the well, the particular formations encountered and so on.

During the drilling of an oil well which is fairly deep, there is ample opportunity for the drill string to be seized at the drill collars. Typically, this will happen when the sidewall of the hole collapses and dirt falls into the annulus around the pipe, thereby seizing the drill string at the drill collars. Even if the hole partially collapses 2 or 3 thousand feet above, the dirt, rocks, etc. which fall into the hole will accumulate just above the drill bit and thereby seize the drill string near the drill collars. Alternately, the drill bit will be deflected somewhat and drift from its intended course, thereby placing the drill string in a bind. So to speak, it forms a key seat where the drill collars are forced to the side of a part of the hole which was previously drilled, and they then tend to lock against the side of the hole. This is binding on the drill string.

When, for any of the above mentioned reasons or other reasons not named, the drill string is seized, it is necessary to free it up. There are several ways of doing this. One way is to use a jar in the drill string for purposes of imparting a substantial impact to the drill string in the immediate vicinity of the place where it is stuck. Since sticking typically occurs just above the drill bit at the drill collars, a jar mechanism in the drill string is quite advantageous.

The present invention is a jar which is installed in a drill string. It is located among the drill collars. It functions as a drill collar itself during routine drilling operations. When the drill string is stuck, the present invention can be used in conjunction with the rotary drilling apparatus to impart a jarring impact to the drill string for jarring it loose from the stuck condition.

Other devices have been provided heretofore for jars to be used in drill strings. It is believed that the present invention constitutes a significant advance over them. It is relatively simple in retrospect and, therefore, less costly in manufacturing. In addition, the present invention utilizes two basic tubular members which further simplifies and defines it over the known devices. Known patents of interest are U.S. Pat. Nos. 3,001,596; 1,627,321; 1,672,464; 2,819,878; 2,819,879; 3,200,895; and 3,371,730.

BRIEF DESCRIPTION OF THE PREFERRED EMBODIMENT

The present invention is summarized as incorporating an upper mandrel and a lower mandrel which partly telescopes into the upper mandrel. The lower mandrel is provided with a set of lugs defined by encircling shoulders protruding from the lower mandrel with the encircling shoulders partly cut away. The upper outer mandrel has grooves which receive the protruding lugs. The grooves, however, are periodically interrupted so that a telescoping spline mechanism is defined. Partial rotational movement is permitted where the lugs lock into receptacles amid the splines to prevent further rotation. The upper mandrel incorporates a packer element therein which abuts and seals against a stinger pipe on the top end of the lower mandrel. The stinger pipe telescopes when the tool is in action. Otherwise, it rotates in unison with the upper mandrel. The packer around the stinger pipe is incorporated for sealing purposes to prevent drilling fluid to pump through the jar of the present invention from escaping around the packer and along the exterior of the lower mandrel telescoped into the upper mandrel. This protects the spline mechanism from drilling fluid.

BRIEF DESCRIPTION OF THE DRAWINGS

FIGS. 1A and 1B together are a sectional view of the drilling jar of the present invention showing internal details of construction of an upper mandrel telescoped around a lower inner mandrel; and FIG. 2 is a sectional view along the line 2—2 of FIG. 1 showing details of construction of a spline mechanism permitting telescoping movement when properly aligned which also permits rotational movement through a fraction of a turn so that the upper and lower mandrels rotate together when desired.

DETAILED DESCRIPTION OF THE PREFERRED EMBODIMENT

Attention is first directed to FIG. 1A where the drilling jar 10 is illustrated. The drilling jar will be described proceeding from the top to the bottom. The drilling jar 10 is adapted to be installed in a drill string with drill collars, the number not being critical and it is connected in the drill string with the typical pin and box connection. To this end, it includes a box 11 at the upper end which opens into an axial passage 12 extending into a tubular, thick walled drill collar indicated at 13. The passage 12 extends downwardly to a shoulder 14 and a larger passage 15 is found therebelow. The enlarged passage 15 is able to receive a stinger pipe 16 on telescoping movement. The tool is dimensioned so that the stinger pipe 16 moves downwardly to the illustrated position of FIG. 1A and it can move upwardly toward the shoulder 14, but it does not bang against the shoulder. It is not necessary that the shoulder 14 limit upward movement of the stinger pipe 16. The shoulder merely defines the enlarged axial passage 15 and sets the limit on the upward penetration of the stinger pipe into the upper mandrel 13.

The mandrel 13 is conveniently formed of multiple pieces. They thread together with a set of threads at 17. The intermediate piece which forms the upper mandrel bears the reference numeral 20. It will be understood that the threaded connection 17 is a convenience for ease of manufacture, namely, the manufacture of the upper mandrel in two components. In addition, the threaded break is located at a point permitting easy access to the packer mechanism to be described so that it can be assembled on the interior of the upper mandrel 13. It is possible to make the mandrel 13 in one piece construction although it is more convenient and economical to make it in the manner illustrated in the drawings.

The upper mandrel is connected in the drill string and thus moves with the upper parts of the drill string. More specifically, the upper mandrel 13 is able to move with the drill string extending from the drilling jar to the well head. This enables it to be manipulated by raising and lowering the drill string utilizing the draw works at the drilling rig. By contrast, the lower mandrel which will be described is tied to the drill bit and the portion of the drill string which is stuck with the drill bit. In routine use, the upper mandrel is thus raised and lowered to be hammered against the lower mandrel to create a jarring movement. The lower mandrel serves somewhat in the fashion of an anvil so that the upper mandrel is used as a hammer against the anvil, thereby improving and accentuating the heavy jarring impact which results from use of the present invention. This jarring impact has been found to be one of the better ways to free a stuck drill string. In particular, it works well with drill strings which are stuck by the accumulation of cuttings and other debris near the bottom of the hole which close the hole and thereby seize the drill string.

The threads at 17 enable the upper mandrel to divide into two parts to enable a packer assembly to be positioned on the exterior of the stinger pipe 16. The stinger pipe 16 extends through the lower portions of the upper mandrel including the component 20. The stinger pipe 16 threads into an internally threaded coupling 22 appended to the upper end of the lower mandrel. The lower mandrel is generally identified by the numeral 25. The lower mandrel includes a portion 26 which has a smaller external diameter sized to permit it to telescope into the upper mandrel. The mandrel portion 26 thus will be described as the telescoping portion of the lower mandrel, the portion 26 terminating at an upwardly facing shoulder 27 above a thicker portion 28 at the lower end of the tool. The mandrel portion 26 thus telescopes into and out of the upper mandrel 13. This telescoping movement carries the stinger pipe upwardly and downwardly as the two major subassemblies move relative to one another. The upper mandrel 13 is formed with a number of internal grooves at 29 and 30. They have preferably uniform shape, and there are at least two in the preferred embodiment, six being illustrated in the embodiment of FIGS. 1A and 1B. The grooves do not extend fully around the mandrel 26 inserted into them. Rather, the several grooves are periodically interrupted. They are interrupted by spline like members better shown in FIG. 2 of the drawings at 33. The protruding splines extend inwardly. It will be observed that each groove is formed with sloping shoulders, and it will be further observed that the splines in the grooves which extend inwardly are themselves periodically interrupted. Restated, the grooves extend fully around the interior of the upper mandrel 13 except that they are interrupted with a longitudinal shoulder. This is better shown in FIG. 2 of the drawings where the shoulder is shown in dotted line at 35. A lug 36 carried on the lower mandrel is rotated into the groove 30 and its penetration is limited by the facing shoulder 35. Restated, the groove 36 is full and complete about 360° except that it is interrupted at each spline member by a longitudinal shoulder internally of the outer mandrel having a thickness of about ½ inch or about 5 or 10° of circumference, whichever is greater. Adjacent grooves 30 are separated by a land 37. The land is interrupted by the spline slots which enable the lugs 36 to slide upwardly and downwardly.

It is possible for the equipment to operate with two grooves, an intervening land, and a single lug on the lower mandrel; however, the device is used in very difficult circumstances, exposed to substantial stress, and is therefore preferably protected by the incorporation of substantial load bearing components. To this end, many grooves are utilized having abutting shoulders for carrying the several lugs. The several lugs themselves are numerous, in the preferred embodiment being found at four levels and incorporating either two or four lugs at each level.

The upper mandrel 13 terminates with a hollow threaded nut 40 which threads to the interior threads on the center component 20 thereof. A lock washer 41 is incorporated between the two for locking the nut in position. The nut 40 is inserted into the upper mandrel to lock the lower mandrel in place after it has been inserted into the upper mandrel. The nut 40 has an internal diameter which is sufficiently small to forbid the lower mandrel from feeding through it.

The grooves 29 and 30 are spaced so that, in the event the lugs 36 are in the uppermost position, the shoulder 44 at the bottom end of the upper mandrel is rested against the shoulder 27 of the lower mandrel. This closes the external gap. When the tool is in this position, the tool is adapted for a routine drilling. Routine drilling is thus initiated by no more than 45° rotation between the two parts which thereafter rotate as a unit.

It will be observed that the stinger tube 16 can telescope up against the shoulder 14, almost touching it, to thereby prevent drilling fluid from flowiing on the exterior of the stinger. The apparatus incorporates a packing assembly generally identified by the numeral 50 which is received in the upper mandrel 13 and which is located immediately adjacent to the stinger. It is located so that the stinger is isolated at all times, thereby preventing the flow of drilling mud away from the annular passage through the tool itself. The apparatus includes an anchor 52 for the packer assembly. The anchor 52 holds a ring 54 in position, and several chevron packings are incorporated at 56. The number of chevrons which are necessary is subject to variation. It is sufficient to include an adequate number for preventing leakage past the packer assembly. All of the chevron packings are held in position by a packing nut 58 which is threaded on the interior of the center portion 20 of the upper mandrel 13. It will be recalled that the mandrel 13 is conveniently manufactured of multiple parts and breaks at the threads 17. This exposes the packing nut 58 for easy assembly and insertion. The several components of the packing assembly are thus inserted around the pipe 16 and the last component is the packing nut 58 which is threaded into the internal threads for the purpose of locking all of the packing assembly together.

The lower end of the tool incorporates a threaded pin 64 which enables the tool to be assembled in a drill string.

The operation of the device will be considered hereinafter. Assume for purposes of discussion that a well has been drilled to a substantial depth and that the drill string incorporates ten drill collars above the drill bit. Further assume that the present drilling jar is located in the drill string above the eighth drill collar. Further assume that the drill string has been pinched by collapse of the well bore whereby an accumulation of debris next to the drill collars pinches or clamps the drill string against continued drilling. At this time, the lower mandrel is positioned so that the uppermost lug is received in the uppermost groove, thereby closing the shoulder 44 against the shoulder 27. As long as drilling proceeds featuring rotation to the right, the device remains closed, not in the extended position of FIG. 1B. When it is determined that the drill string has been stuck, the rotary table is reversed in operation and turned backward or to the left by a distance sufficient to enable the lug 26 to align with the splines cutting across the land 37. Before this time, the lug 36 had been jammed in a counterclockwise fashion against the shoulder 35. This is true for all of the lugs on the lower mandrel. Reverse rotation aligns the lugs to permit telescoping movement. Alignment of the lugs must be achieved first. After this alignment is achieved, the drill string can then be raised. When it is raised, the lower mandrel which is connected to the lower portions of the drill strings remains stuck. The drill string is raised with the lugs 36 moving relatively from groove to groove by passing through the spline cuts formed in the lands 37. The drill string is raised by some distance, typically a distance equal to translation of the uppermost lug to the third groove from the top. The drill string is then dropped, and the shoulder 44 bangs against the shoulder 27 to impart a very substantial jarring impact to the lower part of the drill string. In particular, the impact is delivered to the stuck portion. The drill string is raised and dropped several times. Each time it is raised, a pull can be taken on the drill string to lift the entire string to see if it has been unstuck. If there is no give or movement after jarring, the jarring process is repeated time after time. The equipment of the present invention is substantially constructed to withstand the jarring impact which occurs when the shoulder 44 slams against the shoulder 27. The stinger pipe 16 telescopes almost against the shoulder 14, but they do not contact one another and therefore there is no jarring impact at that shoulder. When it has been determined that the drill string is unstuck, it can be raised completely away from the stuck area or rotated partly to the right to relock the lugs 36 in the grooves.

The foregoing is directed to the preferred embodiment, but the scope of the present invention is determined by the claims which follow.

I claim:

1. A drilling jar for use with a drill string to assist in unsticking the drill string, comprising:

(a) an upper hollow mandrel having
  (1) connector means enabling said upper mandrel to be connected into a drill string;
  (2) a packer therein for sealing against a member inseated thereinto;
  (3) a lower shoulder on said mandrel useable as a hammer;
  (4) first and second spaced encircling internal grooves separated by a land in the lower portion of said mandrel;
  (5) a transverse shoulder interrupting said grooves;
  (6) a transverse groove across said land, said groove cooperating with said land to define a spline rib parallel to the axis of said upper mandrel;

(b) a lower hollow mandrel having
  (1) an upper stinger pipe axially communicated with said lower mandrel and telescoped into said packer for sliding and sealing movement in said upper mandrel;
  (2) an upwardly facing shoulder adopted to be used as an anvil and arranged on said lower mandrel for hammering by said lower shoulder on said upper mandrel;
  (3) connector means at the lower end of said lower mandrel enabling said lower mandrel to be connected to the lower portions of a drill string;
  (4) a protruding lug extending from said stinger pipe and having a profile such that said lug fits into either of said internal grooves and can rotatably move in said grooves until movement carries against said transverse shoulder whereupon said lug is constrained by said shoulder against further rotation in said grooves on drilling where the drill string turns to the right so that said upper hollow mandrel and said lower hollow mandrel rotate together as a unit; and where said lug is moved away from said transverse shoulder and moves into alignment with said transverse groove wherein said lug has a profile to enable said lug to slidably move along said transverse groove as said upper and lower mandrels are telescoped relative to one another; and
  (5) said lug moving between said first and second encircling grooves on telescoping movement wherein the travel of said lug is equal to the stroke of said upper mandrel as it hammers against said lower mandrel to impact a jarring impact to the drill string.

2. The apparatus of claim 1 including N lugs arranged in a circle around said stinger pipe where N is a whole number integer and wherein said transverse shoulders are N in number, and said lugs and said shoulders are arranged at N locations evenly spaced around said stinger pipe.

3. The apparatus of claim 2 wherein said transverse grooves are N in number, and are evenly spaced around said upper mandrel.

4. The apparatus of claim 3 including M sets of lugs evenly spaced from one another along said stinger pipe and wherein M is a whole number integer, and said upper mandrel has at least M + 1 evenly spaced internal grooves which are all similarly constructed with N transverse shoulders.

5. The apparatus of claim 4 including sufficient length on said stinger pipe to permit a stroke of twice the spacing between adjacent spaced internal grooves of said upper mandrel.

6. The apparatus of claim 5 including a first and second threaded portions of said upper mandrel which join and separate adjacent to said packer to enable said upper mandrel to be opened adjacent to said packer to permit access to said packer and wherein said packer includes at least a plurality of seals and a means for compressing said seals.

7. The apparatus of claim 6 including an enlarged axial passage in said upper mandrel for receiving said stinger pipe which enlarged passage extends there along by a length to receive said stinger pipe on its maximum stroke.

8. The apparatus of claim 7 including a narrow passage axially concentric with said enlarged passage.

9. The apparatus of claim 8 including a pin and box connection comprising said connector means on said upper and lower mandrels.

* * * * *